US007097469B2

(12) United States Patent
Jacobs

(10) Patent No.: US 7,097,469 B2
(45) Date of Patent: Aug. 29, 2006

(54) CONTACT INSERT CARTRIDGE FOR PLUGS OF TRACTOR/TRAILER JUMPER CABLES

(75) Inventor: John D. Jacobs, Brea, CA (US)

(73) Assignee: R.A. Phillips Industries, Inc, Santa Fe Springs, CA (US)

( * ) Notice: Subject to any disclaimer, the term of this patent is extended or adjusted under 35 U.S.C. 154(b) by 0 days.

(21) Appl. No.: 10/512,104

(22) PCT Filed: May 5, 2003

(86) PCT No.: PCT/US03/13984

§ 371 (c)(1),
(2), (4) Date: Oct. 21, 2004

(87) PCT Pub. No.: WO03/093036

PCT Pub. Date: Nov. 13, 2003

(65) Prior Publication Data

US 2005/0176265 A1 Aug. 11, 2005

Related U.S. Application Data

(60) Provisional application No. 60/377,517, filed on May 3, 2002.

(51) Int. Cl.
*H01R 12/00* (2006.01)

(52) U.S. Cl. ..... 439/83; 439/246

(58) Field of Classification Search ..... 439/651, 439/680, 290, 701, 639, 686, 695, 284, 34, 439/358, 638, 445, 503, 245–247

See application file for complete search history.

(56) References Cited

U.S. PATENT DOCUMENTS 3,614,709 A * 10/1971 Schweihs ..... 439/246
4,109,989 A 8/1978 Snyder, Jr. et al.
4,179,179 A 12/1979 Lowden
4,211,461 A 7/1980 Wescott (Continued)

OTHER PUBLICATIONS

Society of Automotive Engineers (SAE); Standard SAE J560, revision of Jul. 1998, titled Seven Conductor Electrical Connector for Truck-Trailer Jumper Cable; Warrendale, PA 15096-0001 (11 pages).

*Primary Examiner*—Truc T. Nguyen
*Assistant Examiner*—Edwin A. Leon
(74) *Attorney, Agent, or Firm*—Christie, Parker & Hale, LLP

(57) ABSTRACT

A cartridge for removably connecting to a cable that electrically connects a tow vehicle to a towed vehicle is provided. The cartridge includes a body having a first end and a second end and a plurality of openings extending from the first end to the second end. The cartridge also includes a common contact member having a female contact end and a male contact end, wherein the female contact end is disposed in and the male contact extends from a corresponding one of the plurality of openings, and wherein the female contact end has an outer diameter that is smaller than an inner diameter of the corresponding body opening in which it is disposed to allow for a lateral movement of the female contact end within the body. The cartridge also includes a plurality of noncommon contact members each having a female contact end and a male contact end, wherein each female contact end is disposed in and each male contact extends from a corresponding one of the plurality of openings, and wherein each female contact end has an outer diameter that is smaller than an inner diameter of the corresponding body opening in which it is disposed to allow for a lateral movement of each female contact end within the body.

28 Claims, 11 Drawing Sheets

U.S. PATENT DOCUMENTS 4,245,875 A * 1/1981 Shaffer et al. ..... 439/144
4,865,558 A * 9/1989 Stoner ..... 439/246
5,890,930 A 4/1999 Gerow
6,007,362 A 12/1999 Davis et al.
6,054,779 A * 4/2000 Zubko ..... 307/10.8
6,220,891 B1 4/2001 Hils
6,257,923 B1 7/2001 Stone et al.
6,450,833 B1 * 9/2002 Brown et al. ..... 439/518
6,533,465 B1 3/2003 Lesesky et al.
6,743,025 B1 * 6/2004 Howard ..... 439/35
6,773,285 B1 * 8/2004 Bernat et al. ..... 439/246

* cited by examiner

FIG. 14
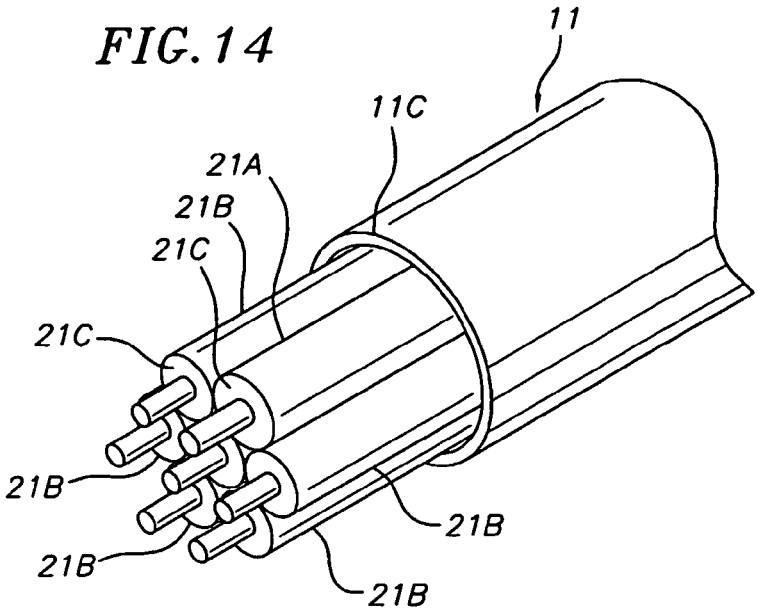
FIG. 15
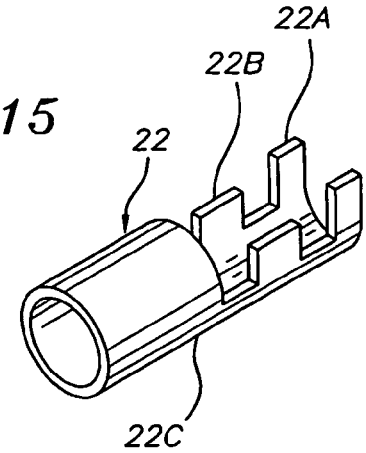
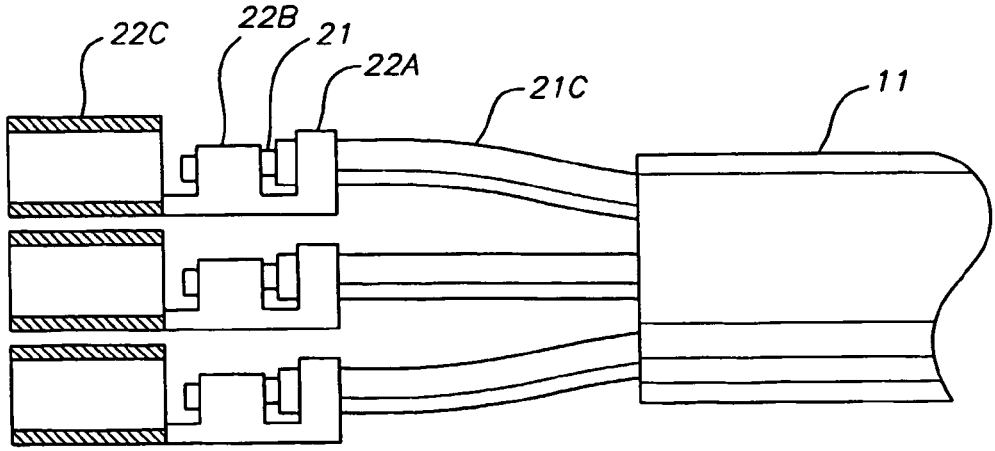
FIG. 16

CONTACT INSERT CARTRIDGE FOR PLUGS OF TRACTOR/TRAILER JUMPER CABLES

CROSS-REFERENCE TO RELATED APPLICATIONS

This application is the National Stage under 35 U.S.C. § 371 of International Application No. PCT/US03/13984 filed 5 May 2003 which claimed the benefit of U.S. Provisional Application No. 60/377,517 filed 3 May 2002.

TECHNICAL FIELD OF THE INVENTION

This invention pertains to the plug-type electrical connectors at the ends of multi-path electrical cables used to provide electrical connections between heavy duty truck tractors and trailers. More specifically, it pertains to a terminal cartridge for such a plug, the cartridge being removable from the overall plug to enable ready replacement of damaged terminals carried in the cartridge.

INCORPORATED REFERENCE DOCUMENTS

SAE (Society of Automotive Engineers) Standard J560 as revised July 1998 and first issued July 1951 is incorporated by reference hereinto. SAE J560 is a standard observed in the U.S. heavy duty trucking industry. The purpose of that standard is to assure physical and functional compatibility in the electrical connectors relied on in that industry to electrically connect any tractor to any trailer without the use of adapters.

BACKGROUND OF THE INVENTION

An effective connection of a heavy duty truck trailer to a truck tractor, either directly or via another trailer, includes a multi-function electrical connection. The connection is made by use of a cable having multiple (preferably seven) wires within it and connectors at the ends of the cable. SAE J560 governs the functions of those wires and of the terminals in the plug-like connector moieties at the cable ends and in the corresponding socket-like connector moieties with which the cable-end connectors are mateable. SAE J560 also governs the relative positions, the geometries and the dimensions of those matable connector moieties. Pursuant to SAE J560, the cable-end moieties are defined as plugs having female contact terminals, and the other moieties (mounted to the tractors and the trailers) are defined as sockets having male contact terminals.

In use of those cables, they commonly are mated to the tractor sockets on a long term basis. When a tractor is not connected to a trailer, the cable remains connected to the tractor, and the cable (which commonly is self-coiling) and its other end connector are stored at the rear of the tractor. It is the connector at the rear (trailer) end of the cable which far more frequently is mated to and unmated from a trailer socket, and which has its terminals exposed to the environment when it is unmated from a trailer socket. That environment can be hostile to the wellbeing of those terminals. As a consequence, the terminals in the plug at the rear end of the cable can be degraded so that they do not make sound contact with trailer socket terminals and need to be repaired or replaced. Other events, such as inadvertent dragging of an unmated cable-end plug on a road surface, can damage the terminals in the plug.

Heretofore, the cable-end connector plugs have been designed, manufactured and assembled in ways which either make it difficult to repair damaged plug terminals or make it necessary to replace the entire cable with its connectors to achieve the desired correction. Plug terminal repairs (or replacements) are either difficult and time consuming or costly to accomplish. A need exists for a way to repair or replace damaged terminals in such cable-end plugs quickly, effectively and economically.

SUMMARY OF THE INVENTION

This invention addresses the need identified above. It does so by locating the plug terminals (also called contacts) which are matable with a tractor or trailer socket in a carrier which is removable from a plug housing in favor of a replacement carrier carrying similar contacts. When mounted in a plug housing, other portions of the contacts than those which mate with socket terminals physically engage other contacts in the housing to which are connected the respective wires or conductors of the cable. Thus, if one or more of the contacts in a cable-end plug become damaged or degraded to an extent requiring correction, correction is achieved by removing from the plug housing the contact carrier containing the damaged contact(s) and inserting in its place an identical or substantially identical new carrier with its contacts.

Generally speaking, the invention provides a terminal contact cartridge for a plug assembly at an end of a multipath electrical cable useful in the connection of a towed vehicle to a tow vehicle. The cartridge comprises a body and a selected plurality of conductive members so carried in the body that the conductive members are nonconductively separated from each other. The cartridge body is externally configured for removable mating in an end of a plug assembly housing. The conductive members have first ends thereof disposed in a selected first array relative to each other at a first end of the cartridge body where the conductive members are accessible. The conductive members also are accessible at an opposite second end of the body where they are disposed in a second array which can be different from the first array. The first end of each conductive member defines a matable contact of a first electrical connector of which the plug assembly itself is a moiety. The second end of each conductive member also defines a matable contact of a second electrical connector within the plug assembly housing.

More specifically, the plug assembly can be one which conforms to SAE J560. In that event, there are seven conductive members in the cartridge body, and the first end of each member defines a female terminal (contact) in conformance with SAE J560. The end of the plug assembly housing into which the cartridge is fittable also conforms to the pertinent provisions of SAE J560.

While the several conductive members in the cartridge may be defined by a pair of terminals connected together by a wire or the like, it is preferred that each conductive member be defined essentially as a one-piece thing, with which minor components, such as bias springs, can be associated if desired. In the latter case, the contacts defined at the opposite ends of each conductive member are coaxially aligned, or substantially so. There is a one-to-one correspondence between the contacts accessible at the opposite ends of the cartridge body.

In one embodiment, the present invention provides a cartridge for removably connecting to a cable that electrically connects a tow vehicle to a towed vehicle. The cartridge includes a nonconductive body having a first end and a second end and a plurality of openings extending from the first end to the second end. The cartridge also includes an electrically conductive common contact member having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body. The cartridge also includes a plurality of electrically conductive noncommon contact members each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body.

In another embodiment, the present invention provides a cable end plug assembly for removably electrically connecting a tow vehicle to a towed vehicle. The assembly includes a cable having a plurality of wires disposed therein, a terminal electrically connected to each wire, wherein each terminal includes a first contact end and a first insulative body overmolded to the terminals and a portion of the cable, such that the terminals and the overmolded portion of the cable are embedded in the insulative body, wherein the insulative body includes a first end having openings corresponding to and aligned with each terminal, such that the first end of the insulative body forms a first moiety of a multicontact first electrical connector. The assembly also includes a removable cartridge. The cartridge includes a second nonconductive body having a first end and a second end and a plurality of openings extending from the first end to the second end, a common contact member having a female contact end and an opposite contact end, wherein the female contact end is disposed in and the opposite contact end extends from a corresponding one of the plurality of openings; the cartridge also includes a plurality of conductive noncommon contact members each having a female contact end and an opposite contact end, wherein each female contact end is disposed in and each opposite contact end extends from a respective corresponding one of the plurality of openings, and wherein the first end of the cartridge body forms a plug-type moiety of a second multicontact electrical connector and the second end of the cartridge body forms a second moiety of the first electrical connector, such that the cartridge forms a removable electrical connection with the contacts of the first insulative body when the cartridge is mated to the first insulative body. The assembly further includes a housing within which the first insulative body is disposed with the cable extending outwardly from one end of the housing. The cartridge is removably mounted in an open opposite end of the housing so that the opposite ends of the cartridge contacts engage the contacts of the first insulative body and establish a connection between the first and second moieties of the first electrical connector within the housing.

In yet another embodiment, the present invention provides a method of making a cable end plug assembly for removably electrically connecting a tow vehicle to a towed vehicle. The method includes providing a cable having a nonconductive covering that surrounds a plurality of conductive wires, wherein each wire comprises a separate nonconductive covering, removing a portion of the cable covering to expose a portion of the wire coverings, removing a portion of each wire covering to expose a portion of each wire and mechanically and electrically connecting a corresponding terminal to each wire. The method also includes attaching each terminal to a corresponding attachment site on a mold load bar to space and orient the terminals in a particular arrangement, overmolding an insulative body to the terminals and a portion of the cable, such that the terminals and the overmolded portion of the cable are embedded in the insulative body, and removing the load bar from the terminals, such that the overmolded insulative body forms a first moiety of an internal first connector of the plug assembly. The method further includes providing a removable cartridge having a first end that forms a second moiety of the internal first connector and a second end that forms a socket-type moiety of a second electrical connector.

BRIEF DESCRIPTION OF THE DRAWINGS

The above-mentioned and other features of the invention are more fully set forth in the following description of embodiments of the invention presented with reference to the accompanying drawings in which:

FIG. 14 shows a cable having a nonconductive covering that surrounds a plurality of conductive wires, wherein a portion of the cable covering has been removed so that a portion of each wire extends from the cable covering;

FIG. 15 shows a terminal for connection to one of the wires of FIG. 14;

FIG. 16 shows the terminal of FIG. 15 attached to each of the wires of FIG. 14;

DESCRIPTION OF THE ILLUSTRATED EMBODIMENTS

Figure 1:
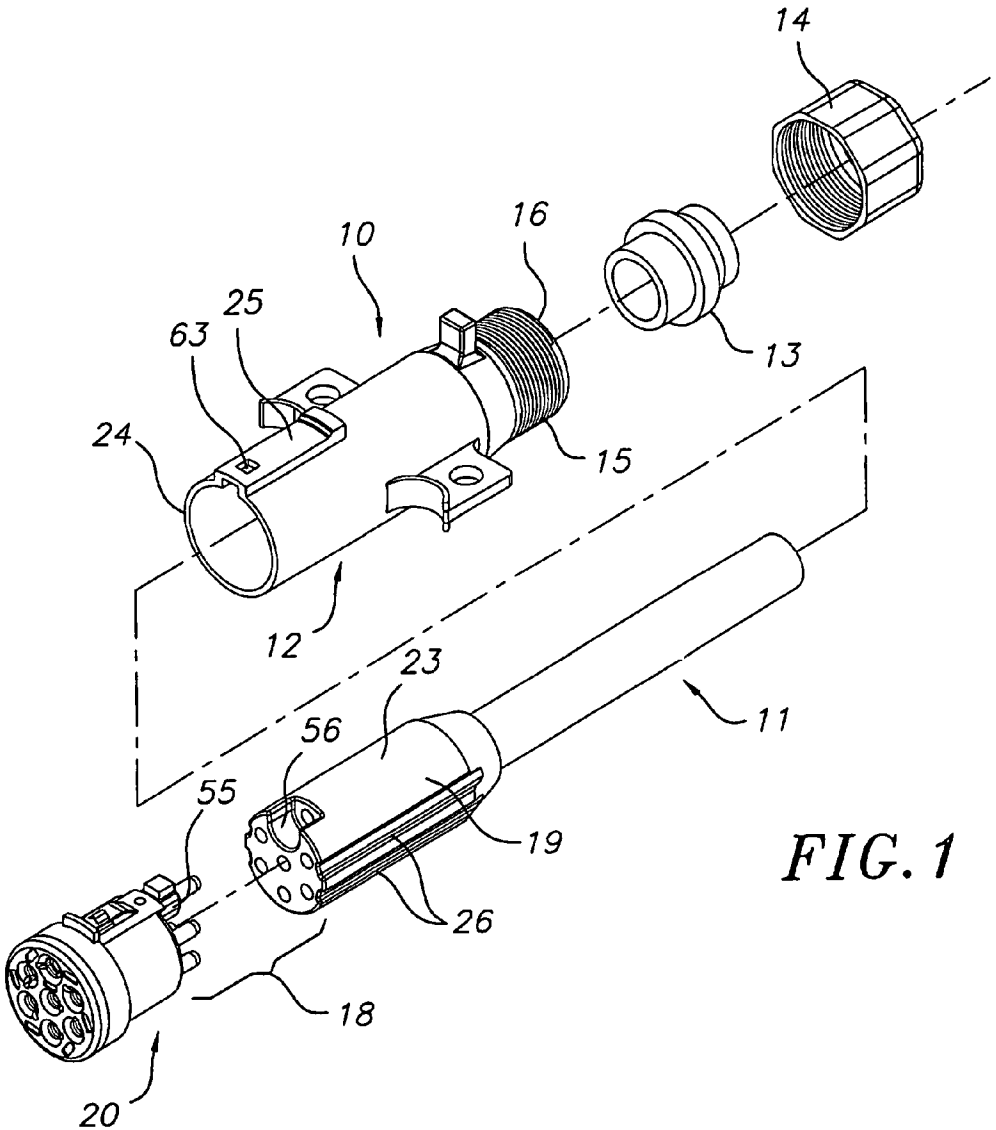
FIG. 1 is an exploded view of a cable-end plug assembly which includes a replaceable contact cartridge.

FIG. 1 is a perspective exploded view showing the relation between major components of a plug assembly 10 at an end of a multi-wire cable 11 useful to electrically interconnect a tow vehicle (such as a heavy duty truck tractor) and a towed vehicle (such as a heavy duty truck trailer). Cable 11 extends through a plug assembly housing 12, through a compressible annular sealing grommet 13, and through an internally threaded compression sleeve 14. The internally threaded compression sleeve 14, in turn, is disposed in surrounding relation to the grommet 13 and threadably engages external threads 15 at a rear end 16 of housing 12.

When the cable 10 is extended through the housing 12, the grommet 13 and the sleeve 14, the cable 10 carries at its end one moiety 19 of an internal (to the housing) first multi-contact electrical connector 18. The other moiety of first connector 18 is defined at the rear end of a cartridge 20 which includes the functional contacts or terminals of a further (second) electrical connector of which plug assembly 10 is a moiety; the other moiety of the further connector is of the socket type, and can be (for example) a socket like any of sockets 15-720, 721, 722, or 724 or 16-720, 722, 724 or 726 (all of which conform to SAE J560) or 16-822 or 826 (which conform to standard ISO 3731) manufactured by Phillips Industries, Santa Fe Springs, Calif. In a fully assembled state of plug assembly 10, both moieties of connector 18 are within housing 12. However, the cartridge 20 may have a front end portion which is outside the housing, closes the end of the housing, and preferably forms the end of the plug assembly.

Consistent with the problem and need described above, plug assembly 10 can be, and preferably is, a component of a connector between a multi-function cable and one or the other of a heavy duty truck tractor or truck trailer. The plug assembly can conform to a relevant interconnection standard, the purpose of which is to assure that all tractors and trailers, in a geographic area where the standard is applicable, can be electrically interconnected without the use of adapters. SAE J560 is such a standard which is applicable in the United States and, as a practical matter, also in Canada and, more recently, Mexico. The accompanying drawings show a plug assembly which conforms to SAE J560; the manners in which this invention can be practiced in the context of other standards will be readily apparent to persons familiar with those other standards.

Figure 13:
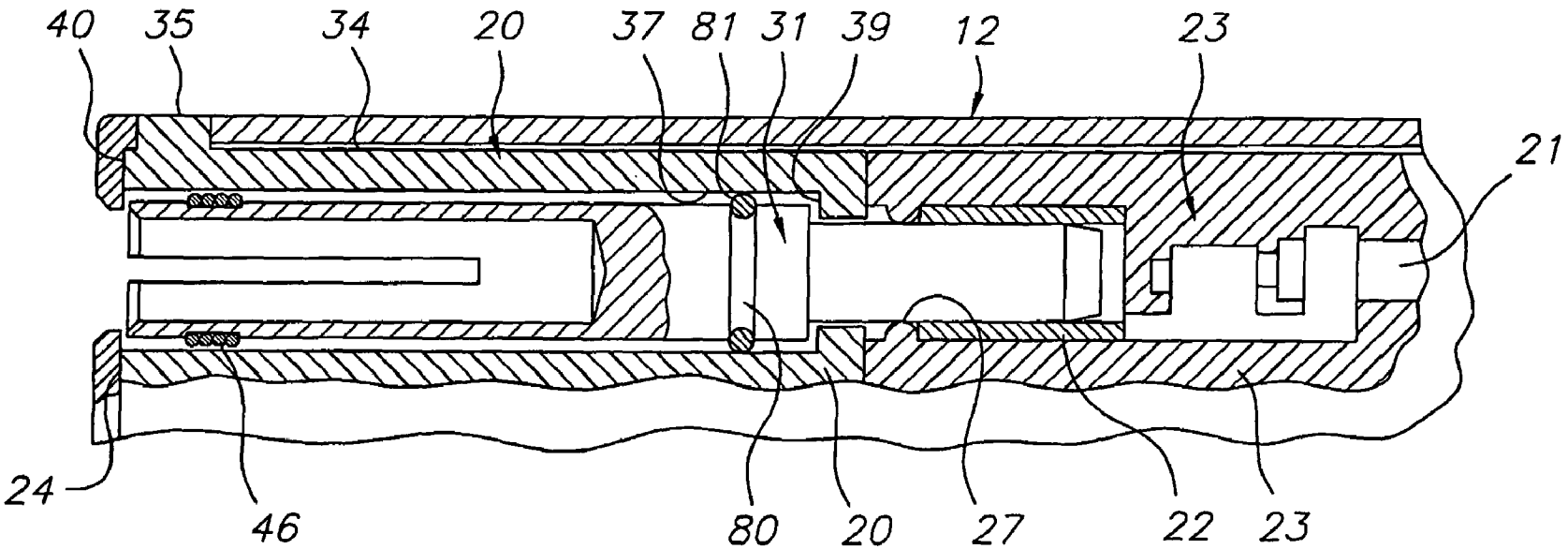
FIG. 13 is a fragmentary cross-sectional elevation view of a contact cartridge fitted into a plug housing and shows the rear end of a cartridge contact member mated with a cooperating contact within the housing.

Thus, in the context of SAE J560, cable 11 includes seven individually insulated wires 21 (see FIG. 13) each of which is conductively connected to a respective one of seven terminals 22 which, together with the adjacent end of the cable, are located within a preferably molded insulative body 23 which forms the preferably plug-type moiety 19 of connector 18. Terminals 22 are accessible via openings in the end of body 23 and, in the arrangement shown in FIG. 13, are of female type. Terminals 22 can be recessed inwardly from the adjacent end face of body 23 with which cartridge 20 can be abutted in the fully assembled state of plug assembly 10, as shown in FIG. 13. The forward ends (left ends in FIG. 13) of terminals 22 can be located just to the rear of inwardly extending circumferential lips or flanges 27 which define, coaxially with the respective terminals, openings which are slightly smaller in diameter than the inner diameters of the terminals. Lips or flanges 27 function as integral o-rings in body 23 to coact in a sealing relation with preferably male terminal pins 42 (described more fully below) in the fully assembled state of the plug assembly. The seals provided by flanges 27 protect terminals 22 from moisture and the like during use of the plug assembly. Body 23 preferably is defined by a relatively hard elastomeric material which has a measure of elastic resilience; the body preferably is molded around and embeds terminals 22 and the adjacent end of cable 11 (described more fully below).

Body 23 preferably is circular in cross-section and is elongated to occupy the rear end of a cavity or chamber in plug housing 12 which is circularly cylindrical in general shape. Housing 12 can be defined of metal or of a suitable synthetic resin, and can be formed by casting or molding processes. Consistent with SAE J560, adjacent its open front end 24, the exterior of housing 12 is shaped to define a locating rib 25 which cooperates with a mating keyway in the sleeve which surrounds and protects the male terminals of a socket conforming to SAE J560. Inner connector socket body 23 can be longitudinally fluted, as at 26, along its exterior to cooperate with orienting ribs (not shown) on the inside of housing 12 to assure that body 23 has the correct angular orientation within the housing in the fully assembled state of plug assembly 10.

FIGS. 14–18 show one embodiment of a method of overmolding the body 23 to the cable 11. As shown in FIG. 14, the cable 11 includes a nonconductive covering 11C which surrounds a plurality of conductive wires 21. The plurality of wires 21 may include a common wire 21A for connection to a common contact member 30 (described below) and multiple noncommon wires 21B for connection to a corresponding noncommon contact member 31 (described below). Each wire 21 preferably includes an individual nonconductive covering 21C.

In one embodiment of the overmolding process, a portion of the cable covering 11C is removed to expose a portion of the wire coverings 21C, and a portion of each wire covering 21C is removed to expose a portion of each wire 21 (as shown in FIG. 14). The exposed portion of each wire 21 is electrically connected a corresponding conductive terminal 22.

FIG. 15 shows an exemplary embodiment of the conductive terminal 22. In one embodiment, the terminal 22 includes a pair of first arms 22A, a pair of second arms 22B and a female contact portion 22C. The terminal 22 is attached to a corresponding wire 21, such as by crimping the first arms 22A to the wire covering 21C and crimping the second arms 22B to the wire 22 (as can be seen for example in FIGS. 13 and 16). The terminal 22 may be further connected to the corresponding wire 21 (electrically and mechanically) by spot soldering the terminal 22 to the wire 21.

Figure 17:
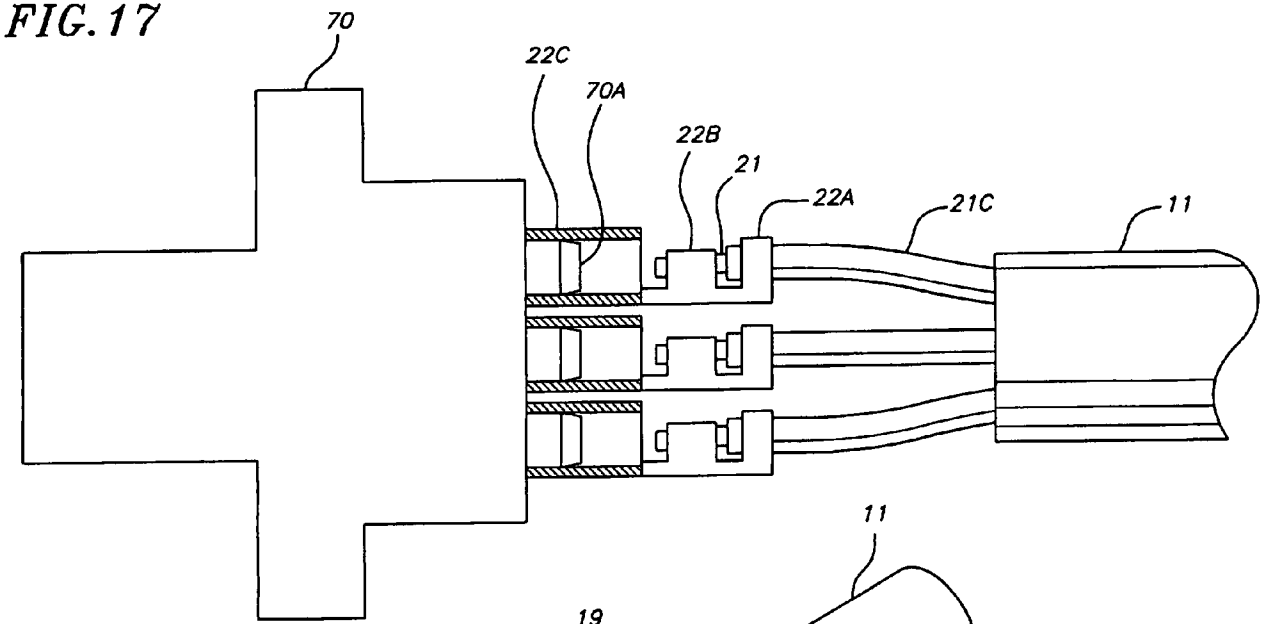
FIG. 17 shows the assembly of FIG. 16 connected to a load bar for spacing and orienting the wires in a particular arrangement prior to an overmolding process.
Figure 18:
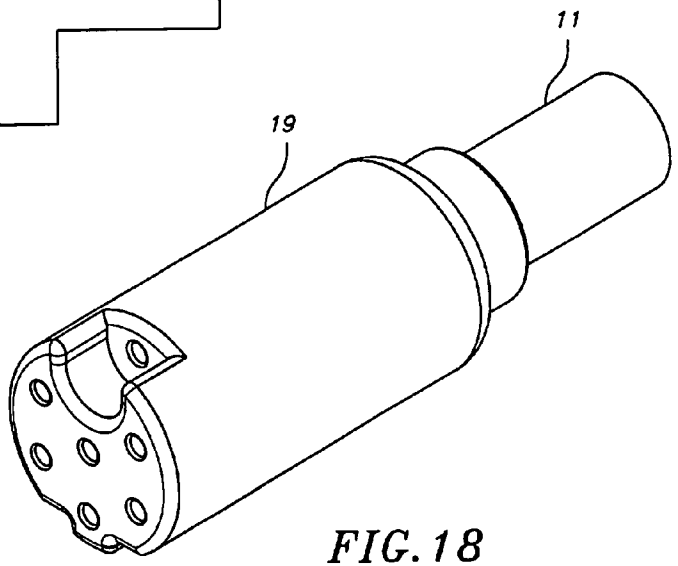
FIG. 18 shows the assembly of FIG. 16 after the overmolding process.

FIG. 17 shows an exemplary embodiment of a mold load bar 70 having attachment sites 70A. In one embodiment of the overmolding process, the terminals 22 are attached to the load bar attachment sites 70A. The cable 11 and the loaded mold bar are inserted into the mold discs of an injection molding machine which overmolds an insulative body 23 to the cable 11, the wire coverings 21C, the wires 21 and the terminals 22. When the overmolding is complete, the load bar 70 is removed and a plug-type connector is formed, specifically, the plug-type moiety 19 of first connector 18 as described above (as shown for example in FIGS. 1, 13 and 18) is formed.

The attachment sites 70A may be spaced around the load bar 70 to conform with the terminal arrangement for plug-type connectors as set forth in SAE J560. In addition, the attachment sites 70A may have color indicators that correspond to color indicators on the wire coverings 21C to facilitate arranging the wires 21 in a particular arrangement.

Cable assemblies for making electrical connections between heavy duty truck tractors and trailers, and between trailers in multi-trailer rigs, have preferably identical plug assemblies at the opposite ends of the cable. It is preferred that both of those plug assemblies be constructed according to this invention, so that each plug assembly includes a removable contact cartridge at the end of the plug housing which releasably mates with a tractor or trailer socket, and so that each plug assembly includes a contact-carrying insulative body molded in a permanent manner to the respective cable end. Accordingly, it is necessary to place the plug housing 12, sealing grommet 13 and compression sleeve 14 on the cable before the cable end terminals 22 are engaged with load bar 70; the housing, the grommet and the sleeve are disposed on the cable outside the mold when insulative body 23 is formed, and they are available on the cable for connection to each other after body 23 has been formed.

The removable contact cartridge 20 is shown in more detail in FIGS. 2–12. As there shown, the cartridge can be comprised by a nonconductive body 28, a front end cap 29, a common contact (terminal) member 30, a plurality (preferably six) of noncommon contact (terminal) members 31, and a latch clip 32. Body 28 can be molded, such as by an injection molding process, of an electrically non-conductive synthetic material. Because the major portion 34 of its length is receivable into plug housing 12, cartridge body 28 is circularly cylindrical with a diameter over most of its length which is sized to fit into the plug housing and with a larger concentric front end portion 35 of preferably shorter axial extent. Common contact 30 is receivable in a through hole 36 formed in body 28, and each of noncommon contacts 31 are receivable in corresponding further through holes 37 formed in that body; see FIG. 3. Adjacent a rear end 38 of body 28, each of holes 36, 37 is configured to define a circumferential shoulder 39 which faces toward a front end 40 of the cartridge body. Those shoulders cooperate with corresponding shoulders 48 defined in the contact members as shown, e.g., in FIGS. 7 and 10. Common contact member 30 can be larger in diameter and more robust than the noncommon contacts 31 as it can be required to conduct more current than the other contacts.

Figure 7:
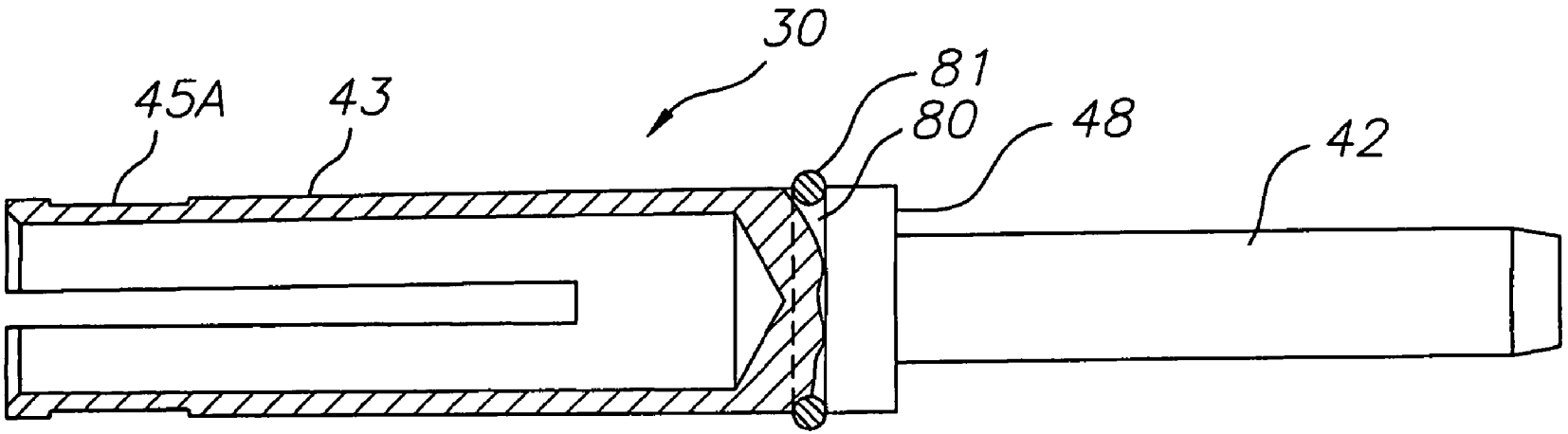
FIG. 7 is an elevation, view, partially in section, of a common contact member for the cartridge.
Figure 9:
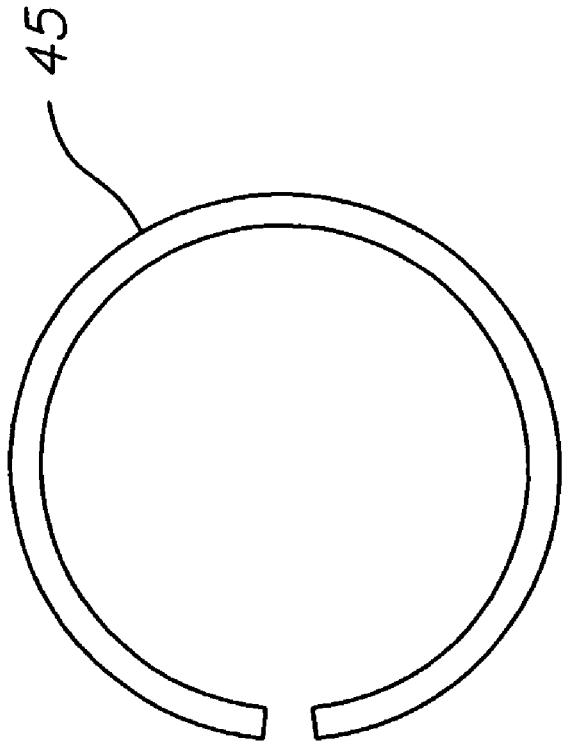
FIG. 9 is an end view of the bias spring of FIG. 8.
Figure 8:
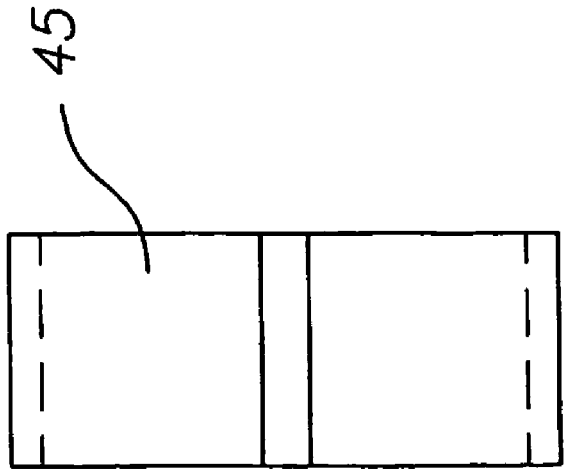
FIG. 8 is a side elevation view of a bias spring for the common contact.
Figure 10:
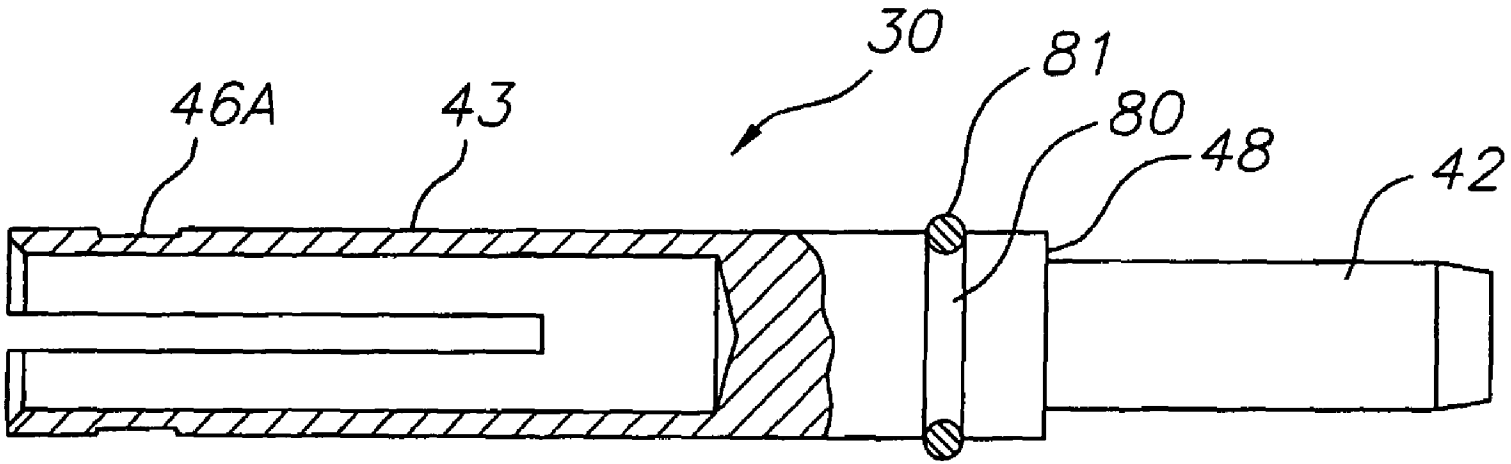
FIG. 10 is an elevation view, partially in section, of a non-common contact member for the cartridge.
Figure 11:
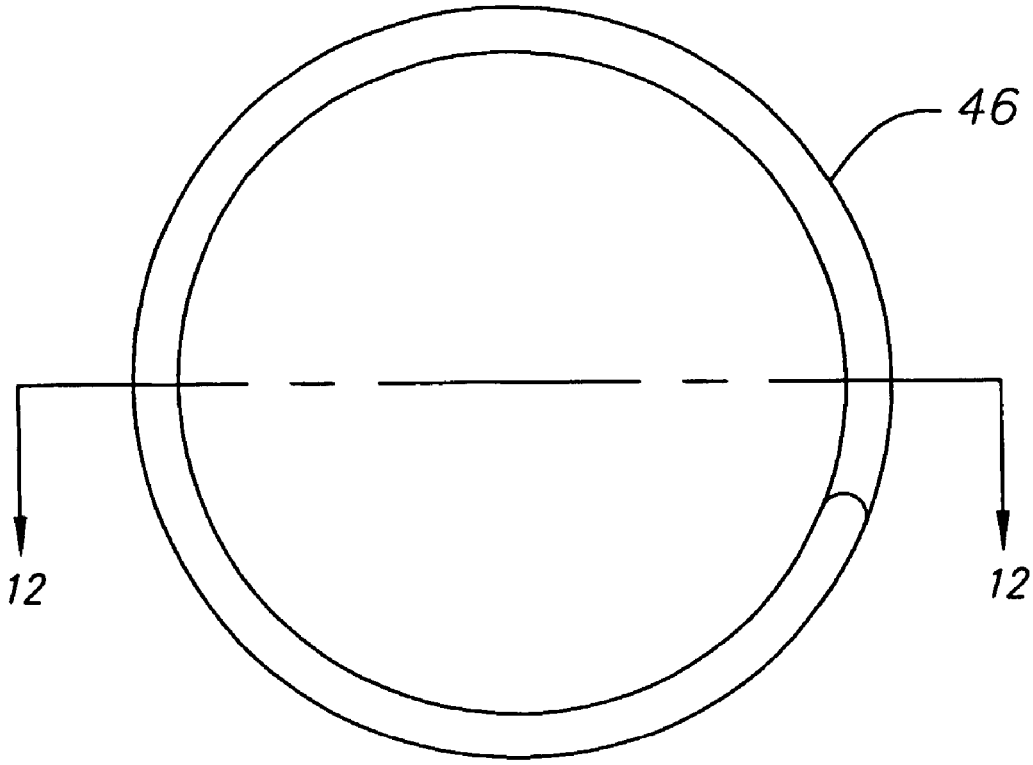
FIG. 11 is an end view of a bias spring for the non-common contact member.
Figure 12:
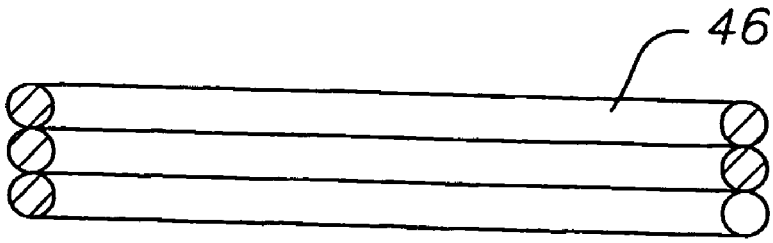
FIG. 12 is a cross-section view taken along line 12—12 in FIG. 11.

The common 30 and noncommon 31 contact members provided in cartridge 20 are shown in FIGS. 7 and 10 respectively. The common contact can be longer than the noncommon contacts by virtue of having a longer (larger) preferably male terminal pin 42 at its rear (right) end. Each of contact members 30 and 31, at their forward ends (to the left in FIGS. 7 and 10) ends, defines a female electrical contact 43 which is shaped and dimensioned to comply with any applicable standard to which plug assembly 10 is to conform.

The hole 36 in the body 28 of the cartridge 20 preferably is larger than the outer diameter of the common contact 30 and the holes 37 in the body 28 of the cartridge 20 preferably are each larger than the outer diameter of the noncommon contacts 31 so that a space exists between the contacts 30 and 31 and their corresponding holes 36 and 37 to allow for lateral movement of the contacts 30 and 31 within the cartridge body 28. Lateral movement of the contacts 30 and 31 within the cartridge body 28 facilitates inserting a socket type connector into the female electrical contact portions 43 of the removable cartridge 20 and allows for tolerancing errors in the positioning of the preferably male terminals of a socket type connector and the female electrical contact portions 43 of the removable cartridge 20.

In addition, the female contacts 43 can be of the longitudinally split sleeve kind, the halves or fingers of which can be biased toward each other by surrounding external springs. The split sleeve structure facilitates inserting the male terminals of a socket type connector into the female contacts 43 of the removable cartridge 20 by allowing lateral movement, or separation of the sleeve halves or fingers. However, the external spring allows the sleeve halves or fingers to be biased towards each other and into contact with the male terminals of a socket type connector when inserted therein.

A split spring steel collar 45 (FIGS. 8 and 9) can be provided as a bias spring for the common female contact, and coil springs 46 (see FIGS. 11 and 12) can be provided as bias springs for the noncommon female contacts. The female contact bias springs fit into exterior recesses 45*a* and 46*a* circumferentially of the female contacts adjacent the front ends of contact members 30 and 31 (see FIG. 13).

Each female contact 43 may also include a groove 80, such as a circumferential groove, for receiving a sealing element 81, such as an elastomeric o-ring, such that the sealing element forms a seal between the hole 36 or 37 and the female contact to prevent moisture and debris from passing thereby.

The transition from the front end female contact aspect of each contact member 30, 31 to its rear end male contact aspect preferably includes a shoulder 48 which cooperates with the shoulder 39 in the pertinent through hole in cartridge body 28; see FIG. 13. After insertion of the contact members into the cartridge body, they are held captive in the body, with very slight axial play, by connecting the cartridge front end cap 29 to the body. Locating features can be provided on the back side of the end cap and on body front end 40 so that the end cap and body can be easily connected in the correct angular relation. While the end cap can be removably connected to the cartridge body, as by screws or the like, it presently is preferred to connect the end cap permanently, as by sonic bonding, to the cartridge body.

Figure 4:
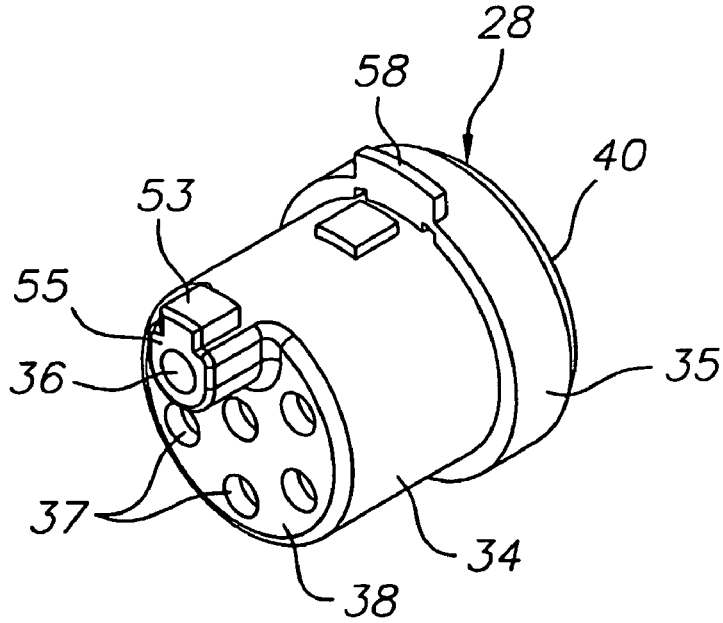
FIG. 4 is a rear end perspective view of the cartridge body.
Figures 4, 5, 6:
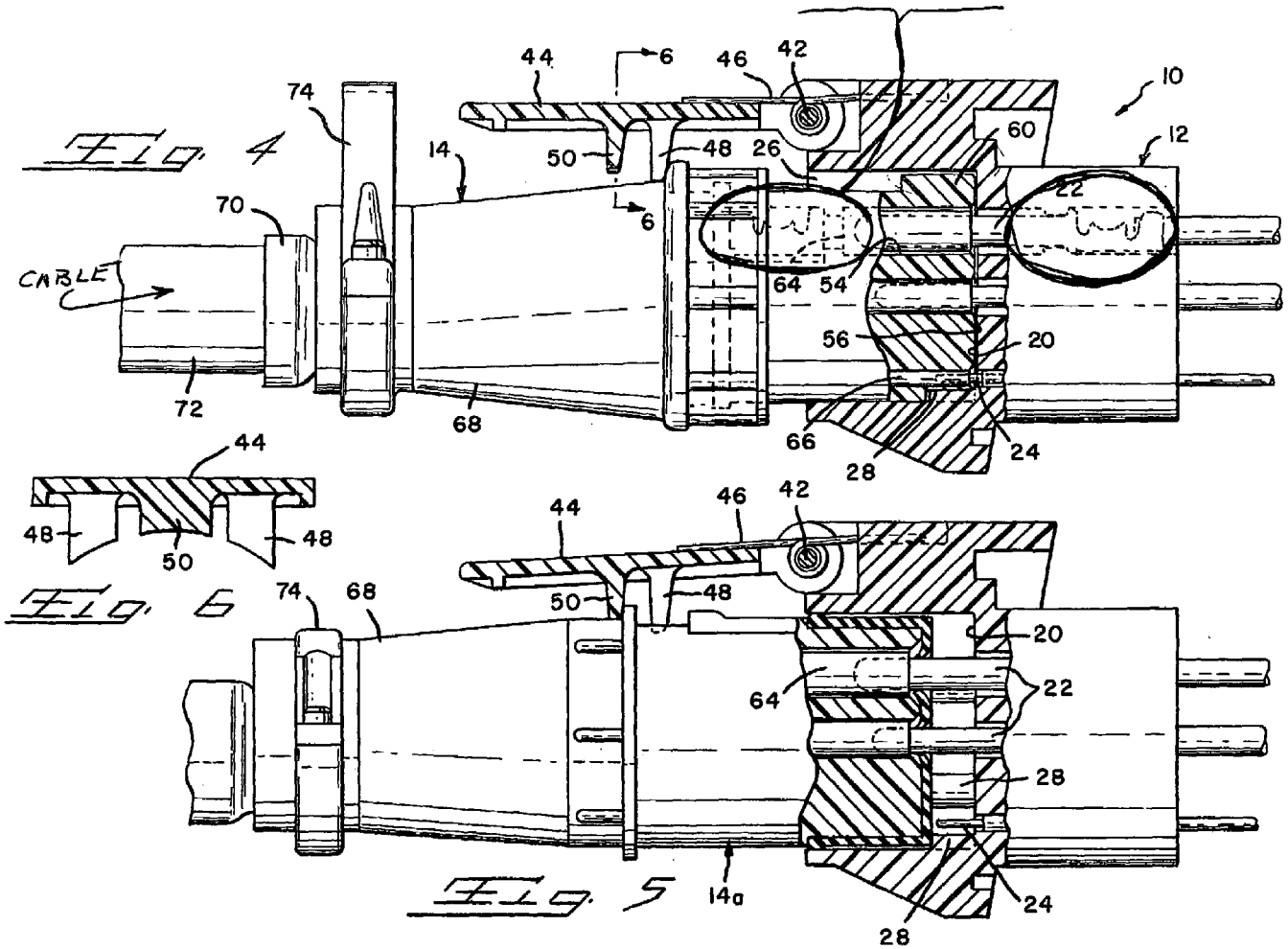
FIG. 5 is a rear perspective view of a front end cap for the cartridge body.
FIG. 6 is a front end view of the cartridge body front end cap.

FIGS. 5 and 6 show the rear and front aspects of the preferred cartridge end cap. Six holes 50 are formed through the end cap in alignment with the locations of the noncommon contact members as positioned in the cartridge body; the holes 50 are larger than the inner diameter of the female contact aspects of the respective noncommon contact members to allow for male pins from a tractor or trailer socket to be inserted therein, but smaller than the outer diameter of the female contact aspects of the respective noncommon contact members to prevent the noncommon contact members from axially extending from the end cap. A single larger hole 51 is formed through the end cap for access to the common contact member. Similar to that described above with respect to holes 50, the hole 51 is larger than the inner diameter of the female contact aspects of the common contact member to allow for a male pin from a tractor or trailer socket to be inserted therein, but smaller than the outer diameter of the female contact aspects of the common contact member to prevent the common contact member from axially extending from the end cap. Hole 51 preferably is at the 12 O'clock position in the end cap in conformance with SAE J560.

Figure 2:
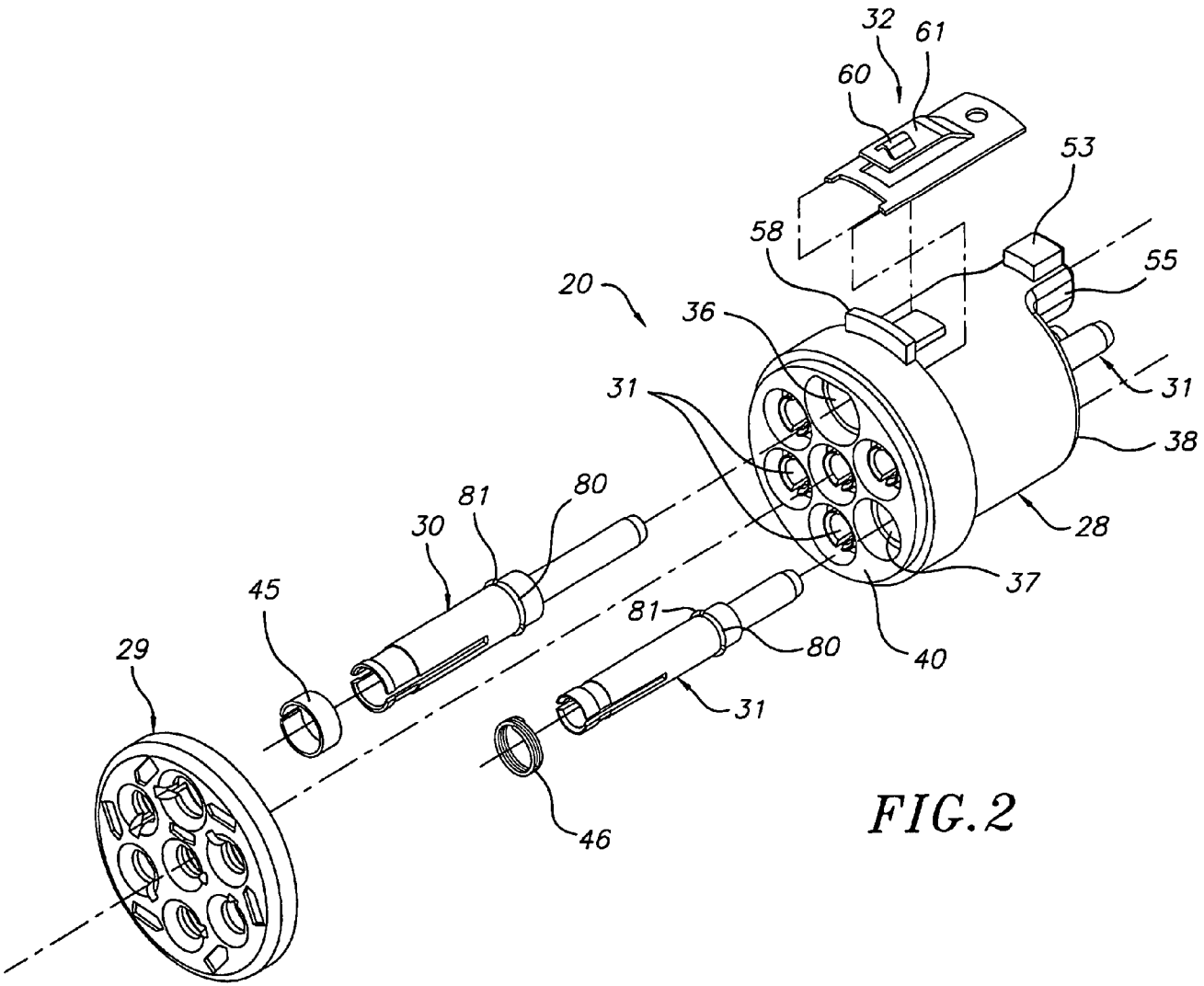
FIG. 2 is an exploded view of the contact cartridge shown in FIG. 1.
Figure 3:
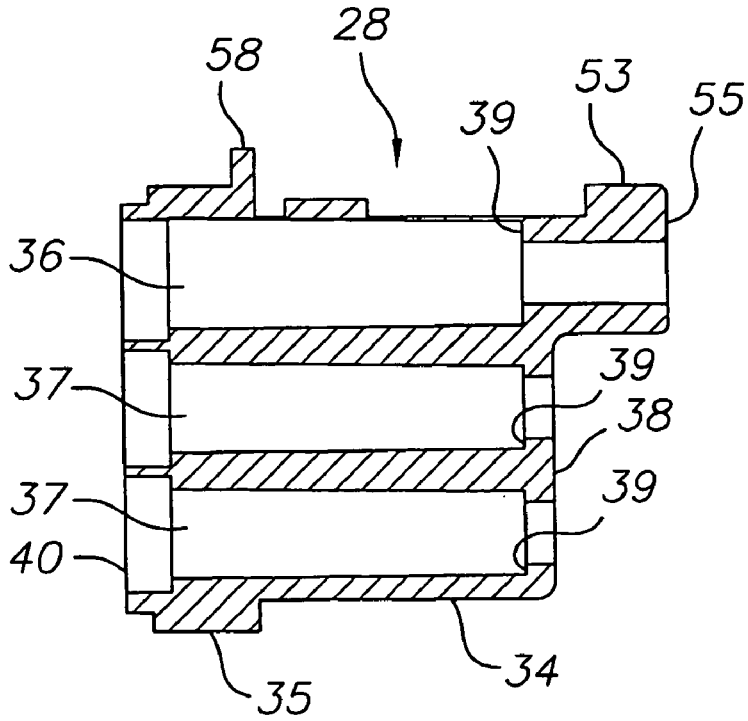
FIG. 3 is a cross-sectional elevation view of the body of the contact cartridge.

Latch clip 32, preferably made of metal, can be snap-fit into place on the top of cartridge 20 in the manner shown in FIGS. 2 and 4. It fits between the larger diameter front portion 35 of the cartridge body and a keying lug 53 raised from the top of the body adjacent its rear end. The keying lug cooperates with the interior of the external locating rib 25 formed in the top front exterior of plug housing 12. Keying lug 53 can be located on a projection 55 from the rear end of the cartridge body through which the rear end portion of common contact member 30 can extend. Projection 55 fits into a recess 56 in the upper part of the front face of body 23, as shown in FIG. 1.

An upstanding projection or flange 58 (FIG. 2) can be provided on the exterior of cartridge body 28 in the way of the forward end of locating rib 25. For example, the flange 58 may be disposed on the front end portion 35 of the cartridge 20, such that the front end portion 35 of the cartridge 20 protrudes from the plug assembly housing 12; see FIG. 13.

Latch clip 32 includes a projection 60 on a deflectable finger 61 of the clip. Projection 60 cooperates within an opening 63 in locating rib 25 to hold cartridge 20 in its mated relation in plug housing 12, in which relation the preferably male terminals at the rear of the cartridge mate with the preferably female contacts 22 in the body 23 of the inner connector plug of the overall plug assembly 10. Cartridge 20 can be removed from the plug assembly by depressing projection 60 to a position below opening 63 by use of a suitable tool, such as a screwdriver.

Alternatively, the housing may comprise an opening for a set screw, such that when the cartridge 20 is in its mated relation in plug housing 12 the set screw secures the cartridge 20 to the housing 12. The cartridge 20 can be removed from the plug assembly 12 by removing the set screw.

The provision of a separable electrical connector 18 within plug assembly 10, itself a moiety of a different electrical connector, provides several benefits. Those benefits are related to the removability of cartridge 20 from the plug assembly and to the extension of a portion of the cartridge, when it is present in the plug assembly, beyond the end of plug housing 12.

The removability of the cartridge provides the benefits of quick, simple and efficient repairability of the plug assembly in the event that any of the female contacts 43 of the plug assembly become sufficiently damaged or deteriorated that they no longer effectively serve their intended functions in the connector of which the plug assembly is a component. Those female contacts can be quickly removed from the plug assembly by disconnecting the cartridge from the plug housing. If the cartridge is constructed so that contact members 30, 31 are permanently captive within the cartridge, the desired repair is made by substituting a replacement cartridge (carrying replacement contact members) for the cartridge which has been removed. If the cartridge has been constructed so that it is openable to enable individual contact members 30, 31 to be removed from the cartridge body, then the defective contact members can be removed and replaced by new members, and the cartridge reassembled and inserted back into the plug housing. In either case, insertion of a cartridge into the plug housing completes internal connection 18; the cartridge is held in the plug housing by the latch action of latch clip projection 60 within the confines of opening 63 in the plug housing, or by a set screw, as described above.

The extension of cartridge 20 beyond the open end of plug housing 12 protects the plug housing from damage if the plug assembly is inadvertently dragged on a road surface. Except in very unusual situations, damage to the plug assembly is confined to the exposed portions of the removable contact cartridge, which is readily replaceable.

Thus, the present invention meaningfully addresses the needs identified above.

As described above, it is preferred that the mating moieties of internal connector 18 have male and female cooperating contacts. It is preferred but not required that the female contacts of connector 18 be mounted in overmolded insulative body 23, and that the male terminals of connector 18 be provided at the rear (inside the housing) end of the cartridge. That gender relation can be reversed or mixed, if desired. Also, it is within the scope of this invention that the cooperating contacts of internal connector 18 can be face abutting or other kinds of contacts. It is only the externally accessible contacts of the plug assembly which are required to be of a specified gender (female for conformance with SAE J560) and to be positioned and dimensioned for mating with a different connector of which the plug assembly itself is a part.

The foregoing description is presented with reference to a presently preferred structural arrangement of this invention and to presently preferred procedures for producing that arrangement. Variations in those arrangements and procedures may be practiced without departing from the scope of this invention.

The invention claimed is:

1. A multi-contact cartridge removably insertable into an open-ended housing of a first connector moiety for engagement with corresponding external contacts of a second connector moiety upon mating of the first and second moieties to make a selectively separable multi-function electrical connection of a multi-conductor cable between a tow vehicle and a towed vehicle, each conductor of the cable having a termination contact connected to it within the first moiety housing, the cartridge comprising:

a nonconductive body having a first end and a second end and a plurality of openings extending from the first end to the second end;

an electrically conductive common cartridge contact member carried by the body and having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body;

a plurality of electrically conductive noncommon cartridge contact members carried by the body and each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body, the cartridge body being sized and arranged to be insertable into and securable within the first connector moiety housing in a selected relation to the housing with each cartridge contact member in conductive engagement within the housing with a respective cable conductor termination contact at one end of the cartridge contact member and with the other end of the cartridge contact member disposed adjacent the open end of the housing so as to be engaged with a corresponding external contact of the second connector moiety upon mating of the first and second moieties.

2. A multi-contact cartridge removably insertable into an open-ended housing of a connector moiety in a selectively separable multi-function electrical connection of a multi-conductor cable between a tow vehicle and a towed vehicle, each conductor of the cable having a termination contact connected to it within the housing, the cartridge comprising:

a nonconductive body having a first end and a second end and a plurality of openings extending from the first end to the second end;

an electrically conductive common contact member having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body;

a plurality of electrically conductive noncommon contact members each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body;

the cartridge body being sized and arranged to be insertable into and securable within the connector moiety housing in a selected relation to the housing with each cartridge contact member in conductive engagement with a conductor termination contact at one end of the contact member and with the other end of the contact member disposed adjacent the open end of the housing;

the first end of the body forming a plug-type moiety in conformity with SAE J560 and the second end of the body forming a socket-type moiety substantially in conformity with SAE J560.

3. A multi-contact cartridge removably insertable into an open-ended housing of a connector moiety for engagement with corresponding external contacts of a second connector moiety upon mating of the first and second moieties to make a selectively separable multi-function electrical connection of a multi-conductor cable between a tow vehicle and a towed vehicle, each conductor of the cable having a termination contact connected to it within the first moiety housing, the cartridge comprising:

a nonconductive body having an outer first end, and an inner second end and a plurality of openings extending from the first end to the second end, an electrically conductive common cartridge contact member having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body;

a plurality of electrically conductive noncommon cartridge contact members each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body, each female contact end comprising a groove and a sealing element received in the groove, such that the sealing element forms a seal between the female contact and the corresponding body opening in which the female contact end is disposed;

the cartridge body being sized and arranged to be insertable into and securable within the first connector moiety housing in a selected relation to the housing with each cartridge contact member in conductive engagement within the housing with a respective cable conductor termination contact at one end of the cartridge contact member and with the other end of the cartridge contact member disposed adjacent the open end of the housing so as to be engaged with a corresponding external contact of the second connector moiety upon mating of the first and second moieties.

4. A multi-contact cartridge removably insertable into an open-ended housing of a connector moiety in a selectively separable multi-function electrical connection of a multi-conductor cable between a tow vehicle and a towed vehicle, each conductor of the cable having a termination contact connected to it within the housing, the cartridge comprising:

a nonconductive body having an outer first end, an inner second end and a plurality of openings extending from the first end to the second end, the second end of the body comprises a projection extending therefrom and defining a keying lug;

an electrically conductive common contact member having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body;

a plurality of electrically conductive noncommon contact members each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body;

the cartridge body being sized and arranged to be insertable into and securable within the connector moiety housing in a selected relation to the housing with each cartridge contact member in conductive engagement with a conductor termination contact at one end of the contact member and with the other end of the contact member disposed adjacent the open end of the housing.

5. A multi-contact cartridge removably insertable into an open-ended housing of a connector moiety in a selectively separable multi-function electrical connection of a multi-conductor cable between a tow vehicle and a towed vehicle, each conductor of the cable having a termination contact connected to it within the housing, the cartridge comprising:

a nonconductive body having a first end and a second end and a plurality of openings extending from the first end to the second end, the body having a length between its ends which is comprised by a front end portion adjacent to the first end of the body and a major portion extending from the front end portion of the body to the second end of the body, and wherein the front end portion has an outer diameter that is larger than an outer diameter of the major portion of the length of the body;

an electrically conductive common contact member having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body;

a plurality of electrically conductive noncommon contact members each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body;

the cartridge body being sized and arranged to be insertable into and securable within the connector moiety housing in a selected relation to the housing with each cartridge contact member in conductive engagement with a conductor termination contact at one end of the contact member and with the other end of the contact member disposed adjacent the open end of the housing.

6. A multi-contact cartridge removably insertable into an open-ended housing of a connector moiety in a selectively separable multi-function electrical connection of a multi-conductor cable between a tow vehicle and a towed vehicle, each conductor of the cable having a termination contact connected to it within the housing, the cartridge comprising:

a nonconductive body having a first end and a second end and a plurality of openings extending from the first end to the second end;

an electrically conductive common contact member having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body, a plurality of electrically conductive noncommon contact members each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body, the opposite contact end of the common contact member defines a male contact and the opposite contact end of each of the noncommon contact members defines a male contact;

the cartridge body being sized and arranged to be insertable into and securable within the connector moiety housing in a selected relation to the housing with each cartridge contact member in conductive engagement with a conductor termination contact at one end of the contact member and with the other end of the contact member disposed adjacent the open end of the housing.

7. A cable end plug assembly for removably electrically connecting a tow vehicle to a towed vehicle comprising:

a cable having a plurality of wires disposed therein;

a terminal electrically connected to each wire, wherein each terminal includes a first contact end;

a first insulative body overmolded to the terminals and a portion of the cable, such that the terminals and the overmolded portion of the cable are embedded in the insulative body, wherein the insulative body includes a first end having openings corresponding to and aligned with each terminal, such that the first end of the insulative body forms a first moiety of a multicontact first electrical connector;

a removable cartridge comprising:

a second nonconductive body having a first end and a second end and a plurality of openings extending from the first end to the second end, an electrically conductive common contact member having a female contact end and an opposite contact end, wherein the female contact end is disposed in and the opposite contact end extends from a corresponding one of the plurality of openings, and a plurality of electrically conductive noncommon contact members each having a female contact end and an opposite contact end, wherein each female contact end is disposed in and each opposite contact end extends from a respective corresponding one of the plurality of openings, and wherein the first end of the cartridge body forms a plug-type moiety of a second multicontact electrical connector and the second end of the cartridge body forms a second moiety of the first electrical connector, such that the cartridge forms a removable electrical connection with the first contacts of the first insulative body when the cartridge is mated to the first insulative body; and a housing within which the first insulative body is disposed with the cable extending outwardly from one end of the housing, wherein the cartridge is removably mounted in an open opposite end of the housing so that said opposite ends of the cartridge contacts engage the first contacts of the first insulative body and establish a connection between the first and second moieties of the first electrical connector within the housing.

8. The cable end plug assembly of claim 7, wherein the first end of the first insulative body forms a plug-type moiety in conformity with SAE J560, the first end of the cartridge body forms a plug-type moiety in conformity with SAE J560 and the second end of the cartridge body forms a socket-type moiety substantially in conformity with SAE J560.

9. The cable end plug assembly of claim 7, wherein the cartridge body comprises a front end portion adjacent to the first end of the cartridge body and a major portion extending from the front end portion of the cartridge body to the second end of the cartridge body, and wherein the front end portion has an outer diameter that is larger than each of an outer diameter of the major portion and an inner diameter of the housing that receives the outer diameter of the major portion, such that the front end portion of the cartridge body extends from the housing when the housing is attached to the cartridge.

10. The cable end plug assembly of claim 7, wherein the first insulative body comprises a flange adjacent to the first contact end of each terminal, and wherein each flange defines a diameter that is slightly smaller than an outer diameter of a corresponding one of said opposite contact ends of the cartridge contact members, such that when said opposite contact ends of the cartridge contact members are electrically connected to the first contact ends of the first insulative body terminals, each flange forms a seal with the outer diameter of a corresponding one of said opposite contact ends of the cartridge contact members.

11. The cable end plug assembly of claim 7, wherein the female contact end of each contact member has an outer diameter that is smaller than an inner diameter of the corresponding cartridge body opening in which it is disposed to allow for a lateral movement of each female contact end within the body.

12. The cable end plug assembly of claim 7, wherein each female contact end comprises a groove that receives a sealing element, such that the sealing element forms a seal between the female contact and the corresponding cartridge body opening in which the female contact is disposed.

13. The cartridge of claim 7, wherein said opposite contact ends of the cartridge contact members are male contacts, and wherein the first contact ends of the first insulative body terminals are female contacts.

14. The cable end plug assembly of claim 7, wherein the second end of the cartridge body comprises a projection extending therefrom that mates with a recess in the first end of the first insulative body to ensure a particular arrangement of said opposite contact ends of the cartridge contact members with respect to the first contact ends of the first insulative body terminals.

15. The cable end plug assembly of claim 14, wherein the cartridge body projection comprises a keying lug that mates with a locating rib in the housing to ensure a particular orientation of the cartridge with respect to the housing.

16. The cable end plug assembly of claim 7, further comprising an end cap attached to the first end of the cartridge body, wherein the end cap comprises openings that correspond to and are aligned with each of the plurality of cartridge body openings, and wherein each end cap opening is smaller in diameter than an outer diameter of each female contact end to prevent each female contact end from axially extending beyond the first end of the cartridge body.

17. The cable end plug assembly of claim 16, wherein a junction between each female contact end and its corresponding opposite contact end forms a shoulder that engages a corresponding shoulder in the cartridge body opening in which the female contact end is disposed, such that each female contact end is axially constrained between the end cap and its corresponding cartridge body opening shoulder.

18. A method of making a cable end plug assembly for removably electrically connecting a tow vehicle to a towed vehicle comprising:

providing a cable having a nonconductive covering that surrounds a plurality of conductive wires, wherein each wire comprises a separate nonconductive covering:

removing a portion of the cable covering to expose a portion of the wire coverings:

removing a portion of each wire covering to expose a portion of each wire:

mechanically and electrically connecting a corresponding terminal to each wire;

attaching each terminal to a corresponding attachment site on a mold load bar to space and orient the terminals in a particular arrangement;

overmolding an insulative body to the terminals and a portion of the cable, such that the terminals and the overmolded portion of the cable are embedded in the insulative body;

removing the load bar from the terminals, such that the overmolded insulative body forms a first moiety of an internal first connector of the plug assembly;

providing a removable cartridge having a first end that forms a second moiety of the internal first connector and a second end that forms a socket-type moiety of a second electrical connector.

19. The method of claim 18, wherein the first end of the insulative body forms a plug-type moiety substantially in conformity with SAE J560, the first end of the cartridge body forms a plug-type moiety in conformity with SAE J560 and the second end of the cartridge body forms a socket-type moiety substantially in conformity with SAE J560.

20. The method of claim 18, wherein providing a removable cartridge includes:

providing a cartridge body having the first end and the second end and a plurality of openings extending from the first end to the second end;

providing a common contact member having a female contact end and an opposite contact end;

inserting the common contact member in a corresponding one of the plurality of openings, such that the female contact end is disposed in and the opposite contact end extends from the corresponding cartridge opening;

providing a plurality of noncommon contact members each having a female contact end and an opposite contact end;

inserting each noncommon contact in a corresponding one of the plurality of openings, such that the female contact end is disposed in and the opposite contact end extends from the corresponding cartridge opening, wherein the female contact end of each contact member has an outer diameter that is smaller than an inner diameter of the corresponding cartridge opening in which it is disposed to allow for a lateral movement of the female contact end within the cartridge body.

21. The method of claim 18, further comprising moveably attaching a housing to the cable before the overmolding of the insulative body to the cable, wherein the housing removably houses the insulative body and a portion of the cartridge.

22. The method of claim 18, wherein mechanically and electrically connecting a terminal to each wire comprises crimping an arm of the terminal to each corresponding wire.

23. The method of claim 22, wherein mechanically and electrically connecting a terminal to each wire comprises crimping a second arm of the terminal to each corresponding wire covering.

24. The method of claim 22, wherein mechanically and electrically connecting a terminal to each wire comprises spot soldering a portion of the terminal to each corresponding wire.

25. A cartridge for removably connecting to a cable useful to electrically connect a tow vehicle to a towed vehicle, the cartridge comprising:

a nonconductive body having a first end and a second end and a plurality of openings extending from the first end to the second end;

an electrically conductive common contact member having a female contact end and an opposite contact end, wherein the female contact end is disposed in and the opposite contact end extends from a corresponding one of the plurality of openings, and wherein the female contact end has an outer diameter that is smaller than an inner diameter of the corresponding body opening in which it is disposed to allow for a lateral movement of the female contact end within the body;

a plurality of electrically conductive noncommon contact members each having a female contact end and an opposite contact end, wherein each female contact end is disposed in and each opposite contact end extends from a corresponding one of the plurality of openings in the body, and wherein each female contact end has an outer diameter that is smaller than an inner diameter of the corresponding body opening in which it is disposed to allow for a lateral movement of each female contact end within the body; and an end cap attached to the first end of the body adjacent to which end the contact ends of the contact members are disposed, the end cap defining openings that correspond to and are aligned with each of the plurality of body openings, and each end cap opening is smaller in diameter than an outer diameter of each adjacent female contact end to prevent each female contact end from axially extending beyond the first end of the body.

26. The cartridge of claim 25, wherein a junction between each female contact end and its corresponding opposite contact end forms a shoulder that engages a corresponding shoulder in the body opening in which the female contact end is disposed, such that each female contact end is axially constrained between the end cap and its corresponding body opening shoulder.

27. A multi-contact cartridge removably insertable into an open-ended housing of a first connector moiety for engagement with corresponding internal contacts of the first moiety and with corresponding external contacts of a second connector moiety upon mating of the first and second moieties to make a selectively separable multi-function electrical connection between a tow vehicle and a towed vehicle, the cartridge comprising:

a nonconductive body having a first end, a second end, and a plurality of openings extending from the first end to the second end;

an electrically conductive common cartridge contact member carried by the body and having a female contact end and an opposite contact end, the female contact end being disposed in a corresponding one of the plurality of openings, and the female contact end having an outer diameter that is smaller than an inner diameter of the corresponding body opening in which it is disposed to allow for a lateral movement of the female contact end within the body;

a plurality of electrically conductive noncommon cartridge contact members carried by the body and each having a female contact end and an opposite contact end, each female contact end being disposed in a corresponding one of the plurality of openings in the body, and each female contact end has an outer diameter that is smaller than an inner diameter of the corresponding body opening in which it is disposed to allow for a lateral movement of each female contact end within the body, the cartridge body being sized and arranged to be insertable into and securable within the first connector moiety housing in a selected relation to the housing with each cartridge contact member in conductive engagement within the housing with a respective internal contact of the first moiety at one end of the cartridge contact member and with the other end of the cartridge contact member disposed adjacent the open end of the housing so as to be engaged with a corresponding external contact of the second connector moiety upon mating of the first and second moieties.

28. A multi-contact cartridge removably insertable into an open-ended housing of a connector plug at one end of a multi-conductor cable useful to make a multi-function electrical connection between a tow vehicle and a towed vehicle, each conductor of the cable having a termination contact connected to it within the housing, the cartridge comprising:

a nonconductive body having an outer end, an inner end, and a plurality of holes extending through the body between those ends;

an electrically conductive common cartridge contact member having a female contact end and an opposite contact end and disposed in a corresponding one of the plurality of cartridge body holes, the female contact end is disposed in its hole adjacent the outer end of the body and has an outer diameter that is smaller than an inner diameter of the corresponding body hole to allow for a lateral movement of the female contact end within the body;

a plurality of electrically conductive noncommon cartridge contact members each having a female contact end and an opposite contact end and disposed in corresponding ones of the other cartridge body holes adjacent the outer end of the body, each noncommon contact member female contact end having an outer diameter that is smaller than an inner diameter of its hole to allow for a lateral movement of the female contact end within the cartridge body, The cartridge body being insertable into and securable within the plug housing in a selected relation to the plug housing with the opposite end of each cartridge contact in conductive engagement within the plug housing with a respective cable conductor termination contact and with the outer end of the cartridge body disposed adjacent the open end of the plug housing.

* * * * *

UNITED STATES PATENT AND TRADEMARK OFFICE

CERTIFICATE OF CORRECTION

PATENT NO. : 7,097,469 B2
APPLICATION NO. : 10/512104
DATED : August 29, 2006
INVENTOR(S) : Jacobs It is certified that error appears in the above-identified patent and that said Letters Patent is hereby corrected as shown below:

Column 18, lines 42 and 43, Claim 28 Delete "the cartridge body, The",
Insert --the body; the--

Signed and Sealed this

Twentieth Day of March, 2007

JON W. DUDAS
*Director of the United States Patent and Trademark Office*